United States Patent [19]

Chang et al.

[11] 4,429,987

[45] Feb. 7, 1984

[54] EARLY FUSER ROLL CLOSURE WITH REDUCED FORCE

[75] Inventors: Jack P. Chang; Marc L. Steinbrecher, both of Boulder, Colo.

[73] Assignee: International Business Machines Corporation, Armonk, N.Y.

[21] Appl. No.: 348,886

[22] Filed: Feb. 16, 1982

[51] Int. Cl.[3] ..... G03G 15/20

[52] U.S. Cl. ..... 355/14 FU; 355/3 FU; 355/77; 219/216; 432/60

[58] Field of Search ..... 355/3 FU, 14 FU; 219/216, 388, 469; 118/60, 641, 642, 643; 432/60

[56] References Cited

U.S. PATENT DOCUMENTS

| | | | |
|---|---|---|---|
| T947,012 | 4/1975 | Brandon et al. | 219/216 |
| 4,038,026 | 7/1977 | Wada et al. | 432/60 |
| 4,162,847 | 7/1979 | Brandon | 355/14 |
| 4,232,959 | 11/1980 | Ateya et al. | 355/14 FU X |
| 4,363,549 | 12/1982 | Brown et al. | 355/14 FU X |

*Primary Examiner*—A. T. Grimley
*Assistant Examiner*—Joan Pendegrass
*Attorney, Agent, or Firm*—Gregory A. Conley; E. C. Hancock; J. Jancin, Jr.

[57] ABSTRACT

An early roll closure method and apparatus associated with an electrophotographic or xerographic device for fixing a toner image onto a copy sheet by application of heat and pressure. A lower closing force is exerted on the fuser rollers during early roll closure than when fixing an image to a copy sheet. The use of a backup roll made of bare metal facilitates this technique. This early roll closure method also allows the temperature of the heated fuser roll to be reduced along the entire circumference. The early roll closure is only allowed to occur on the first sheet of a copy or fusing run.

20 Claims, 4 Drawing Figures

EARLY FUSER ROLL CLOSURE WITH REDUCED FORCE

DESCRIPTION

This application is related to the commonly assigned copending application entitled "Electromechanically Operated Fuser Roll Closure", Ser. No. 145,084 filed Apr. 30, 1980, U.S. Pat. No. 4,363,549.

TECHNICAL FIELD

This invention relates generally to a fuser roll apparatus in a toner fixing station associated with an electrophotographic or xerographic device and more particularly to such an apparatus wherein an electromechanically operated latch in conjunction with a special cam selectively engages and disengages the heated fuser roll and associated backup roll at a different closure force for early roll closure than for affixing the developed latent image to the sheet.

BACKGROUND ART

In the process of xerography, a light image corresponding to the original to be copied is typically recorded in the form of a latent electrostatic image upon a photoconductive member. This latent image is developed, that is to say, made visible, by the application of a pigmented thermoplastic resin, commonly referred to as toner. The thus developed latent image is thereafter transferred from the photoconductive member onto a copy sheet, such as for example, paper. The copy sheet is subsequently passed to a fusing apparatus which affixes the image onto the sheet and is later discharged from the machine as a final copy.

One approach to fixing the toner particles onto the copy sheet has been to pass the copy sheet with toner images thereon through a fusing nip formed by a heated fuser roll and a backup roll. As it passes therethrough, the copy sheet is simultaneously pressed and heated so that the toner becomes softened and firmly attached to the copy sheet.

In such a fusing arrangement, opening and closing of the fuser nip is commonly controlled by a cam rotatable in synchronization with movement of the copy sheets. Frequently therefore, during the processing of variable length sheets (i.e., sheets of different length than the selected standard which is the longest anticipated sheet length), the rollers are allowed to remain in contact during periods in which no copy sheet is disposed therebetween. This prolonged direct contact commonly results in the overheating of the backup roll. Such overheating of the roller may result in a paper jam as the copy sheet will tend to follow the backup roll rather than continuing along the intended paper path beyond the fuser station. This backup roll sticking problem is especially aggravated during the fusing of duplex copies (i.e., sheets with toner copy on both sides) due to the cohesive nature of the toner. Overheating of the roller surface may also result in a phenomena referred to in the printing art as "offset" wherein toner adheres to the roller surface and is transferred to the same or next copy sheet.

Substantial damage may also be caused to the rollers from entrapment of copy sheets between the heated fuser roll and the backup roll when there is a loss of power during a copying operation. It is desirable therefore that the fuser rollers remain in an open position during standby mode and similarly during a copying operation that the fusing nip be closed only when there is paper between the rollers. Thus, it is desirable that the fusing nip be opened during the intersheet gap that may exist between adjacent copy sheets and be closed only when the next sheet arrives. Likewise, when a paper jam is detected, control of the closure mechanism is desirable so that fuser roller opening may be effected and damage to the rollers avoided. Further, it is desirable to open the fuser nip to facilitate maintenance. IBM TDB "Fuser Configuration" (5/81, pp. 5622–5623) describes the details of a pivoting and latching mechanism useful for this purpose.

Another problem exists when the heated fuser roll surface is contaminated by paper resin because of sustained copy runs. The heated fuser roll becomes sticky and therefore tends to offset and/or wrap on a heavily toned copy. Early roll closure is a known effective method of minimizing this problem for a fuser nip which is normally open. Early roll closure involves bringing the backup roll (whose temperature is, for example, on the order of 180° F.) into circumferential engagement with the heated fuser roll (whose temperature is, for example, on the order of 355° F.) prior to paper arriving at the fuser nip. This early closing of the nip allows the temperature of the heated fuser roll in the fuser nip to be reduced to a stable operating level by a brief period of conduction of heat to the backup roll. IBM TDB "Electromagnetically Latchable Damper Assembly" (7/80, pp. 474–475) describes an interruptable linkage associated with a heated fuser roll and a backup roll while the May 1981 IBM Technical Disclosure Bulletin in the article entitled "Fuser Configuration" (pp. 5622–5623) describes an arrangement in which a spring controls the closure force between the heated fuser roll and the backup roll.

Yet another problem associated with contemporary fuser rollers is wear of those rollers from operation under the relatively high closure pressure involved in fusing. Thus the useful life of such rollers is extended by minimizing the closure pressure level and/or time of closure when fusing is not performed.

The capability to override the contour of the cam and thus open the fuser nip during intersheet gaps, upon detection of paper jams or other emergency condition, and to facilitate maintenance is disclosed and claimed in copending application Ser. No. 145,084, filed Apr. 30, 1980.

Accordingly, it is the principal object of this invention to provide an improved xerographic toner fixing apparatus.

It is another object of this invention to provide an improved method and apparatus for early roll closure.

It is still another object of this invention to provide for an early roll closure which requires less closing force than that needed to fuse images to sheets.

A further object of this invention is to provide for improved heat conduction between the heated fuser roll and the backup roll.

DISCLOSURE OF THE INVENTION

The embodiment disclosed for the present invention provides an improved fuser roller closure mechanism in an electrophotographic or xerographic device having a pair of fuser rollers and a linkage mechanism coupling a control cam and the fuser rollers. In accordance with the invention, an electromechanically operated latch or selectively engageable latch, in the form of a solenoid, is interposed in the linkage mechanism coupling the control cam and fuser rollers. The solenoid is arranged so that a portion of its magnetic flux path passes through each of two independently pivotable arms. One of the arms acts as a cam follower and the other is coupled to the fuser rollers. The latter arm effects opening and closing of the fuser nip. So long as the solenoid is operated (i.e., energized via application of actuation power to the solenoid), the mechanism is controlled solely by the rotation of the cam. If the solenoid is not operated (i.e., deenergized or deactuated) however, the arms become disengaged (i.e., separated) and the fuser rollers are maintained in an open position. Thereafter, until the solenoid is again operated, the rollers are unaffected by rotational movement of the cam. In the preferred embodiment of this invention the cam has two high dwells, one which serves to produce early roll closure and the other which serves to close the fuser rolls to fuse the image to the sheet. This results in producing a closing force during early roll closure that is substantially less than the force exerted between the heated fuser roll and the backup roll during the fusing of an image to a sheet thereby reducing roll wear. The contour of the cam is such that the total time associated with early roll closure corresponds to substantially the time required to travel the circumference of the heated fuser roll. This allows the temperature of the heated fuser roll to be reduced along the entire circumference immediately prior to the entry of paper between the fuser roll and the backup roll. The backup roll is typically made of a bare metal to more effectively conduct heat from the heated fuser roll to the backup roll than a coated backup roll.

This invention also uses the overriding capability embodied in the selectively engageable latch or electromechanically operated latch to limit early roll closure to just before the first copy of each copy run.

BRIEF DESCRIPTION OF THE DRAWING

The invention will now be particularly described by way of example, with reference to the accompanying drawing in which.

BEST MODE FOR CARRYING OUT THE INVENTION

Figure 1:
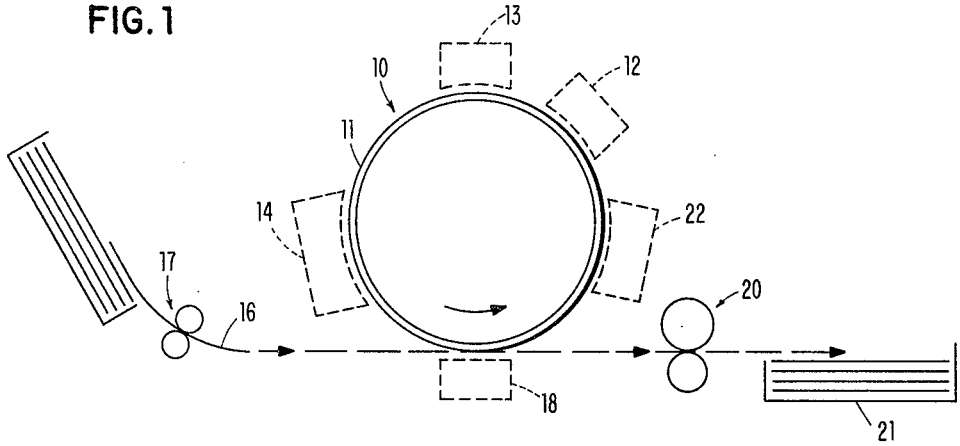
FIG. 1 is a schematic representation of a xerographic copying apparatus having a fuser roller fixing station incorporating the features of the present invention therein.

Referring to FIG. 1, there is depicted schematically, the various components of a typical xerographic copying apparatus in which the features of the present invention may be implemented.

Inasmuch as the art of xerographic copying is well known, the various processing stations for producing a copy of an original document are represented in FIG. 1 in block form, and are defined in terms of functionality.

Still referring to FIG. 1, the xerographic copying apparatus includes a rotatable drum 10 having a photoconductive surface 11. As the drum rotates in a counterclockwise direction, photoconductive surface 11 is caused to pass sequentially through a series of xerographic processing stations.

The first of these stations is a charging station 12 where a uniform electrostatic charge is deposited onto the photoconductive surface.

The second, exposure station 13, includes an exposure mechanism having a housing for supporting the original (i.e., master) document to be copied. At station 13, the original document is scanned by means not shown in a timed relationship with the movement of drum 10 to form a light image thereof. This light image is projected onto the charged portion of photoconductive surface 11. In this manner, the charge in the exposed areas of surface 11 is dissipated, thereby forming a latent electrostatic image on surface 11 which corresponds to the informational areas of the original document.

The latent electrostatic image recorded on photoconductive surface 11 is then rotated to development station 14. At station 14, xerographic developing material, including toner particles having an electrostatic charge opposite that of the latent electrostatic image, is introduced to the latent electrostatic image to form a toner powder image on the photoconductive surface.

With continued reference to FIG. 1, a copy sheet 16 is advanced by sheet feeding apparatus 17 to transfer station 18. Sheet 16 is advanced into contact with drum 10 in a timed sequence so that the toner powder image developed on photoconductive surface 11 contacts the advancing copy sheet at transfer station 18. Once the toner powder image is transferred to sheet 16, the sheet is advanced to toner fusing assembly 20, where the toner powder image is permanently affixed to the copy sheet. The detailed operation of the toner fusing assembly will be described hereinafter in greater detail with reference to FIG. 2.

Once the fusing operation is completed, the finished copy sheet passes to an output tray 21. The surface of drum 10 is thereafter cleaned at drum cleaning and discharge station 22 in preparation for the next copy cycle.

Figure 2:
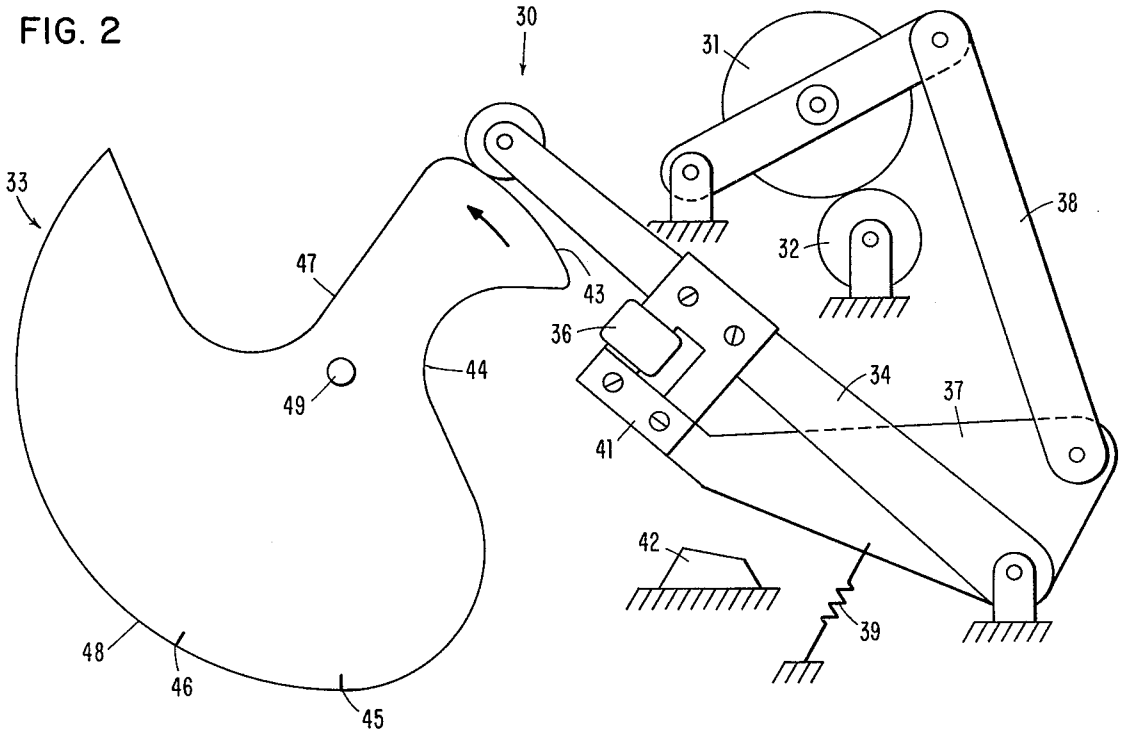
FIG. 2 is a schematic representation of the electromechanically operated latch assembly for selectively moving a heated fuser roll and associated backup roll into and out of circumferential engagement.

Referring now to FIG. 2, fuser assembly 30 includes a heated fuser roll 31 and a backup roll 32. Heated fuser roll 31 cooperates with backup roll 32 to define a fusing nip through which a sheet of copy material having a toner image thereon passes. The copy sheet is so oriented that the side thereof bearing the toner image contacts heated fuser roll 31. The toner image is thereby affixed to the copy sheet. The fusing nip formed by fuser rollers 31 and 32 is designed so as to be capable of being opened and closed under mechanical cam control, the cam 33 being rotatable in synchronization with the movement of the copy sheets relative to the rollers. Pivoted on cam 33 and mounted thereon so as to follow the contour of the cam is follower arm 34 to which solenoid 36 is attached. Also pivoted on the same shaft is lever arm 37 which through linkage 38 is connected so as to be capable of effecting the shifting of the surfaces of backup roll 32 and hated fuser roll 31 between open (i.e., no surface contact) and closed (i.e., surface contact) positions. Spring means 39 are provided for normally biasing fuser rollers 31 and 32 in an open position. Other suitable biasing means may be used to accomplish the same result.

The closed loop magnetic flux path of solenoid 36 includes a portion of follower arm 34 and of lever arm 37. Actuation of solenoid 36 while the magnetic flux path portions of the arms are in proximity to each other, causes lever arm 37 to which armature 41 is attached and follower arm 34 to become fixedly connected. Once connected, the arms move as a unit and further cause backup roll 32 and heated fuser roll 31 to open and close in response to the rotation of cam 33. High dwell 48 in the contour of cam 33 is designed to facilitate opening and closing of the fuser rollers based on the trailing and leading edges, respectively, of a sheet with a predetermined maximum anticipated length. This ensures that all sheets of equal or shorter length than a predetermined maximum anticipated length will be properly fused (i.e., the fuser rollers can remain in contact for at least the entire length of the sheet). IBM TDBs "Electromagnetically Latchable Damper Assembly" (7/80, pp. 474–475) and "Dual-Function Solenoid Core" (11/79, p. 2225) describe details of solenoid construction potentially useful as components for lever or linkage control.

Figure 3:
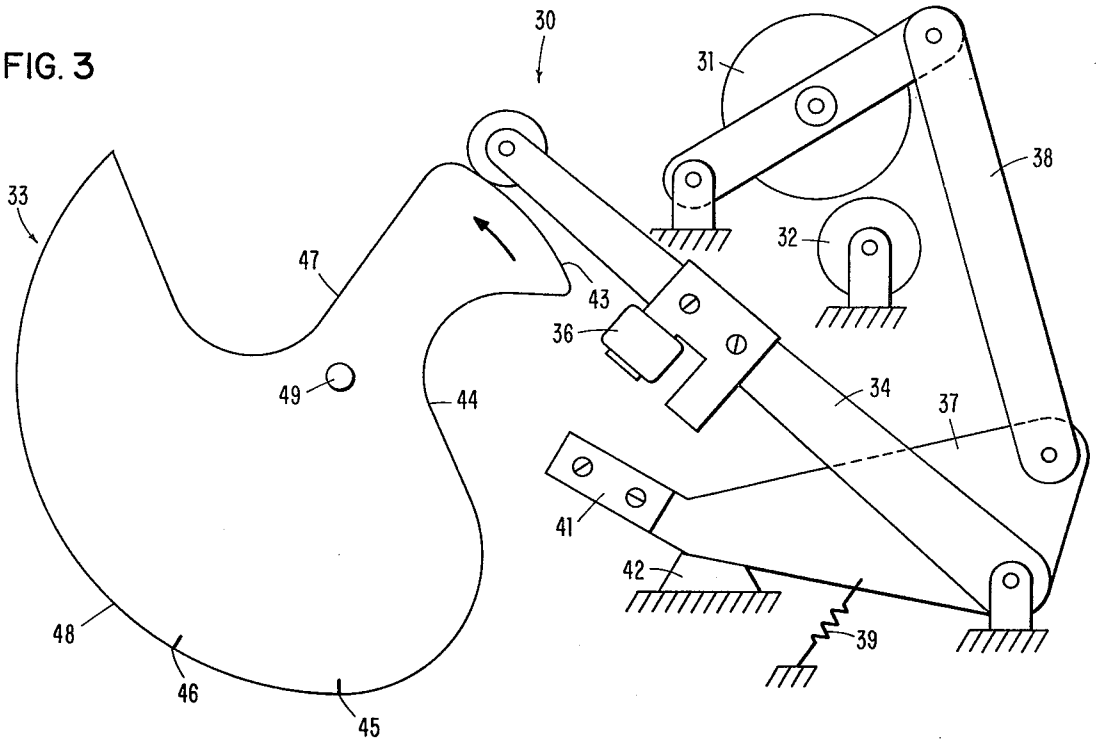
FIG. 3 is a schematic representation of the electromechanically operated latch assembly when the solenoid of the latch assembly is deenergized and the fuser rollers are thereby always in an open position.

Some xerographic copying devices apply a release agent, such as a silicone oil to the outer surface of the heated fuser roll so as to provide the heated fuser roll with an outer surface which has a relatively low affinity to tackified toner particles. While the use of the silicone oil release agent has minimized some of the problems associated with the use of the fuser assembly, occasionally, toner particles may be nonetheless offset to the heated fuser roll. As a result, toner particles are transferred to the surface of the heated fuser roll with subsequent transfer to the backup roll during periods when no copy paper is in the nip. Toner particles may also be picked up by the backup roll during fusing of duplex copies. As a result of this toner offset, the copy sheet often becomes wrapped about the backup roll or heated fuser roll, thereby causing jamming due to the cohesive nature of the toner. The fuser apparatus employed in the present invention is so designed that when a paper jam is detected or when maintenance is required, solenoid 36 is deenergized thereby allowing follower arm 34 and lever arm 37 to separate under the force applied by biasing spring 39 as shown in FIG. 3. Lever arm 37 then moves to stop 42. Deenergization of solenoid 36 thus results in the immediate separation of fuser rollers 31 and 32 by effectively interrupting the cam linkage. Thereafter, until solenoid 36 is again energized, heated fuser roll 31 and backup roll 32 remain in the open position and are unaffected by the rotational movement of the cam. That is, deenergizing solenoid 36 provides the capability to override the opening and closing of the fuser rollers dictated by the contour of cam 33.

The interposition of the solenoid in the control linkage in this manner, allows for the selective interruption of the closure mechanism. Thus, during the copying of variable length sheets, opening of the fusing nip during the intersheet gap may be easily effected by deenergization of the solenoid. That is, dwell portion 48 of cam 33 is designed for paper of a predetermined maximum anticipated length. The cam is mechanically interconnected to control opening and closing of the fuser rollers in an appropriately timed relation as such maximum length sheets are fused. Whenever a shorter sheet is being handled, the solenoid is deenergized at a point in time correlated to the actual sheet length being handled. This results in an appropriately earlier fuser roller opening than for the longer sheets. Such opening results in a reduction in the closure time of rollers 31 and 32 as well as in reduction of overheating of the backup roll and therefore the adverse consequences associated therewith, for example, backup roll sticking. Similarly, the fuser rollers will assume an open position whenever there is a loss of power, as in such a case, the solenoid will be automatically deenergized. The problems of copy sheet entrapment and roller damage, associated therewith, are thereby avoided.

An ideal early roll closure for any fuser apparatus is to reduce the temperature of heated fuser roll 31 along the entire heated fuser roll circumference immediately prior to the entry of paper between heated fuser roll 31 and backup roll 32 and yet not overheat backup roll 32. Further another objective is not to significantly reduce the life of the rollers and particularly heated fuser roll 31.

Backup roll 32 is preferably made of bare metal (e.g., steel) but the invention is applicable to coated backup rolls as well. Regardless, it is not necessary to close the fuser nip for the temperature stabilizing early closure period at the same force required to fuse an image to a sheet. In general, a bare metal backup roll 32 more effectively conducts heat from heated fuser roll 31 to backup roll 32 than a conventional coated backup roll. High dwell 43 in the contour of cam 33 is also such that early roll closure is approximately 20% of the force required to fuse images to the paper; therefore, the life of heated fuser roll is not significantly reduced due to early roll closure. To avoid overheating backup roll 32 and also to not unnecessarily stress heated fuser roll 31, solenoid 36 is deenergized during dwell 43 periods after the first sheet of a copy or fusing run (i.e., one or more successive copies or fused sheets). This allows early roll closure to occur only prior to the first sheet of a copy or fusing run as a result of overriding the contour of cam 33 by selectively deenergizing solenoid 36.

Specifically the early roll closure of the present invention operates in the following fashion. When the copier is idle, follower arm 34 rests at low dwell 47 of cam 33. After an operator pushes a start button, solenoid 36 is energized and the copier begins to run. Heated fuser roll 31 and backup roll 32 are closed as the nip force increases from zero to approximately 24 pounds while follower arm 34 rises from low dwell 47 to high dwell 43. The total time for roll closure here is preferably long enough for the entire circumferential surface of roll 31 to contact roll 32 through one rotation of roll 31. A typical early roll closure period is approximately 742 ms. Heated fuser roll 31 and backup roll 32 briefly open again as follower arm 34 descends from high dwell 43 to low dwell 44. The rollers are again closed as follower arm 34 rises from low dwell 44 to point 45 on high dwell 48 on cam 33. Because cam 33 is mounted to rotate around shaft 49 with a significantly greater radius to dwell surface 48 as compared to the radius to surface 43, high dwell 48, on which points 45 and 46 lie, pushes follower arm 34 up higher than high dwell 43. As a result a higher closure force is exerted on heated fuser roll 31 and backup roll 32 when follower arm 34 is on high dwell 48 than when the follower arm is on high dwell 43. It is during high dwell 48 that images are fused to paper between heated fuser roll 31 and backup roll 32. The force increases from zero to approximately 120 pounds from low dwell 44 to high dwell 48. The total closure time here is approximately 300 ms prior to the arrival of paper at the fuser nip before point 45 on high dwell 48. Thus approximately 1042 ms of closure time for rolls 31 and 32 passes between the start of high dwell 43 and the arrival of paper before point 45 on high dwell 48. The total roll closure time is adequate to ensure at least one rotation of rolls 31 and 32 while in contact with one another. Therfore, the temperature of the entire heated fuser roll circumference is stabilized by the early roll closure technique employed in the present invention.

As the first copy enters the fuser nip before point 45 on high dwell 48, heated fuser roll 31 and backup roll 32 remain closed with an approximately 120 pound nip force while follower arm 34 travels on high dwell 48. The fuser rollers are opened again after the paper clears the fuser nip. This opening is the result of either releasing solenoid 36 at the end of dwell 48, or the transition from high dwell 48 to low dwell 47 for paper of a predetermined maximum anticipated sheet length. For shorter sheets, the opening of the fuser rollers is due to the overriding of the contour of cam 33 by deenergizing solenoid 36. Follower arm 34 is allowed to run through high dwell 43 without actually closing the fuser rollers due to the continued deenergization of solenoid 36 for subsequent sheets in the same copy or fusing run.

Figure 4:
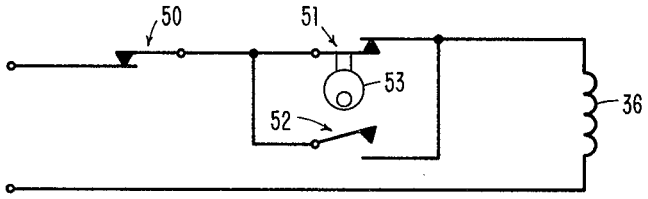
FIG. 4 is a schematic representation of electrical circuitry for controlling the energization of the solenoid of the latch assembly.

The basic circuitry for controlling the energization and deenergization of solenoid 36 to open and close the fuser rollers can include an arrangement of switches such as that shown in FIG. 4. Normally closed switch 50 is employed in the circuit, for example, to deenergize solenoid 36 in response to the detection of sheets shorter than a predetermined maximum anticipated sheet length, detection of dwell 43 time periods after the first sheet of a copy or fusing run, or detection of a paper jam or some other condition requiring maintenance for which fuser roller opening is desired. On the detection of the condition, switch 50 is opened and the solenoid deenergized. Switch 51 is provided so as to be opened and closed cyclically by dwells 43 and 48 as cam 53 is rotated during machine operation. If this cyclic opening and closing is timed with the rotational movement of cam 33 (see also FIG. 2), solenoid 36 can be deenergized (i.e., switch 51 can be opened) as a function of the position of cam 33. Switch 52 is normally open but is closed for a brief period to initiate a roll closure cycle since switch 51 is normally open until follower arm 34 at least approaches one of the larger radius peripheries of cam 33. Note that appropriate opening and closing of switch 51 is obtainable by yet another cam, if desired.

The means for detecting the first sheet of a copy or fusing run could, for example, include a clock generator, a counter, a two input OR gate, and a photodetector switch system.

The clock generator would generate a clock that is in a logic one state for the time required for follower arm 34 to travel from the trailing edge of high dwell 43 to the leading edge of high dwell 43 and in a logic zero state for the time required for follower arm 34 to travel high dwell 43 itself. This clock represents the desired state of switch 50 for sheets which are not the first sheet of a copy of fusing run (i.e., switch 50 is closed when the clock is in a logic one state and open when the clock is in a logic zero state). Therefore, for sheets other than the first sheet of a copy or fusing run, early roll closure due to high dwell 43 would be overridden by deenergizing solenoid 36.

The counter would be used to count to a preset time, for example, 30 seconds. The preset time represents the maximum time allowed between sheets being fed into the fuser nip without employing an early roll closure (i.e., the next sheet fed into the fuser nip after the counter reaches the preset time is by definition the first sheet of a copy or fusing run). The counter is reset by the photodetector switch system which detects a sheet entering the fuser nip. The photodetector switch system could be comprised of a light beam that is interrupted by the presence of a sheet. If the counter reaches the preset time, the counter output goes to a logic one and remains there until it is reset. If the count is reset before reaching the preset time, the counter output remains at a logic zero. An initial power-up also sets the counter output to a logic one.

The clock and the counter output are both inputs to an OR gate. The OR gate output is an input to the control means for switch 50 (this control means could be, for example, just an input when switch 50 is another OR gate—if switch 50 is a two-input OR gate, one input would be grounded and the other input would be the output of the OR gate above whose inputs are the clock and the counter output). When the OR gate output is a logic one switch 50 is closed. When the OR gate output is a logic zero, switch 50 is open.

The detecting means, therefore functions as follows. Upon initial power-up the counter output is set to logic one and switch 50 is closed until the counter is reset. As the first sheet is detected entering the fuser nip (i.e., this entry and detection occurs after early roll closure has occurred) the counter is reset; however, the output of the OR gate remains a logic one due to the clock. The counter output stays at a logic zero on subsequent sheets as long as the time between sheets is less than the preset time. The state of the clock controls switch 50 when the counter output is at this zero logic level. When the intersheet gap equals or exceeds the preset time the counter output goes to logic one and switch 50 is correspondingly closed to allow for early roll closure during high dwell 43. As the counter is reset by the first sheet as it enters the fuser nip, the clock again controls switch 50.

While the present invention has been particularly described with reference to the preferred embodiment thereof, it will be understood by those skilled in the art that various changes in form and detail may be made therein, without departing from the spirit and scope of the invention as illustrated in the appended claims.

We claim:

1. A xerographic toner fixing apparatus comprising:

substantially parallel first and second cylindrical fuser rollers;

biasing means for maintaining the peripheral surfaces of said fuser rollers in an open position;

a rotatable cam with at least a first high dwell and a second high dwell;

a linkage mechanism coupling said cam to at least one of said fuser rollers; and means for rotating said cam whereby the peripheral surfaces of said fuser rollers are shifted between open and closed positions in accordance with the contour of said cam and the closing force exerted between said fuser rollers during said first high dwell is less than the closing force exerted between said fuser rollers during said second high dwell.

2. A xerographic copying apparatus comprising:

a pair of fuser rollers;

a rotatable cam with at least a first high dwell and a second high dwell;

means for rotating said cam;

a linkage mechanism including first and second arms with said first arm being mounted for following the contour of said cam and said second arm being connected to one of said fuser rollers for shifting the peripheral surfaces of said rollers between open and closed positions;

a selectively engagable latch for selectively coupling said second arm to said first arm so that said arms are fixedly connected whereby the movement of said second arm follows the movement of said first arm to cause said rollers to open and close in response to the contour of said cam;

a control means for selectively operating said latch;

biasing means for maintaining the peripheral surfaces of said rollers in the open position when said latch is disengaged, said cam dwells being constructed and arranged for cooperating with said biasing means so that the closing force exerted between said fuser rollers during said first high dwell is less than the closing force exerted between said fuser rollers during said second high dwell.

3. A xerographic copying apparatus in accordance with claim 2, wherein said latch comprises:

electrical solenoid means attached to one of said arms, the closed loop magnetic flux path of said solenoid means including a portion of each of said arms, and means for selectively applying actuation power to said electrical solenoid means whereby actuation of said solenoid means while said magnetic flux path portions of said arms are in proximity to each other causes said arms to become fixedly engaged and to further cause said rollers to open and close in response to the contour of said cam, whereas deactuation of said solenoid means causes said arms to separate and to cause said rollers to remain in the open position.

4. An apparatus according to claims 1 or 2 wherein said cam is mounted at a point which forces said linkage mechanism to move further away from the mounting point of said cam when said linkage mechanism is in contact with said second high dwell than when said linkage mechanism is in contact with said first high dwell.

5. A xerographic toner fixing apparatus comprising:

substantially parallel first and second cylindrical fuser rollers;

biasing means for maintaining the peripheral surfaces of said fuser rollers in an open position;

a rotatable cam with at least a first high dwell and a second high dwell;

a linkage mechanism coupling said cam to at least one of said fuser rollers, said linkage mechanism including:

an electromechanically operated latch;

control means for selectively operating said latch; and means for rotating said cam whereby the peripheral surfaces of said fuser rollers are shifted between open and closed positions in accordance with the contour of said cam when said latch is operated and the closing force exerted between said fuser rollers during said first high dwell is less than the closing force exerted between said fuser rollers during said second high dwell.

6. An apparatus according to claims 1, 2 or 5 wherein said second high dwell is higher relative to said linkage mechanism than said first high dwell.

7. An apparatus according to claims 1, 2 or 5 wherein at least the surface of at least one of said fuser rollers is made of bare metal.

8. An apparatus according to claims 1, 2 or 5 wherein one of said fuser rollers is a heated fuser roll and the other of said fuser rollers is a backup roll.

9. An apparatus according to claim 8 wherein at least the surface of said backup roll is made of bare metal.

10. A xerographic copying apparatus according to claim 2 additionally comprising:

means for serially feeding sheets between the peripheral surfaces of said fuser rollers in synchronization with the rotation of said cam;

detection means coupled to said control means for detecting which sheet is the first sheet of said copy run and when sheets have entered into or exited from the fuser nip created by the closed position of said fuser rollers;

whereby early roll closure occurs only prior to said first sheet of said copy run as said latch is not operated by said control means after said first sheet of said copy run when said first arm approaches said first high dwell to override the contour of said cam, and said latch is operated by said control means prior to the entry of sheets into said fuser nip.

11. A xerographic toner fixing apparatus according to claim 5 additionally comprising:

means for serially feeding sheets between the peripheral surfaces of said fuser rollers in synchronization with the rotation of said cam;

detection means coupled to said control means for detecting which sheet is the first sheet of said fusing run and when sheets are about to enter or exit from the fuser nip created by the closed position of said fuser rollers;

whereby early roll closure occurs only prior to said first sheet of said fusing run as said latch is not operated by said control means after said first sheet of said fusing run when said linkage mechanism approaches said first high dwell to override the contour of said cam, and said latch is operated by said control means prior to the entry of sheets into said fuser nip.

12. An apparatus according to claims 1, 2 or 5 additionally comprising:

means for serially feeding sheets between the peripheral surfaces of said fuser rollers in synchronization with the rotation of said cam;

wherein due to the contour of said cam said fuser rollers are closed for a period of time corresponding to substantially one revolution of one of said fuser rollers prior to the arrival of sheets at the fuser nip to reduce the temperature of at least one of said fuser rollers along the entire circumference immediately prior to the entry of sheets between said fuser rollers.

13. A method for producing early roll closure in a xerographic toner fixing or copying apparatus comprising the steps of:

heating at least one of a pair of fuser rollers;

serially feeding sheets between the peripheral surfaces of said fuser rollers;

detecting when sheets are about to enter or exit the fuser nip produced by the closed position of said fuser rollers;

a first closing of said fuser rollers prior to the entry of sheets between said fuser rollers with a first closing force;

a first opening of said fuser rollers; a second closing of said fuser rollers immediately prior to the entry of sheets between said fuser rollers with a second closing force substantially greater than said first closing force;

a second opening of said fuser rollers after the exit of sheets from between said fuser rollers.

14. A method of producing early roll closure in a xerographic toner fixing or copying apparatus according to claim 13 wherein the time associated with said first closing is substantially the time required to reduce the temperature of at least one of said fuser rollers along the entire circumference thereof immediately prior to the entry of sheets between said fuser rollers.

15. A method of producing early roll closure in a xerographic toner fixing or copying apparatus according to claims 13 or 14 additionally comprising the step of:

detecting which sheet is the first sheet of said fusing or copy run;

whereby early roll closure occurs only prior to said first sheet of said fusing or copy run.

16. The method of operating fuser rollers in a device wherein at least one of said rollers is heated for fusing fusible material on sheets passed between said rollers comprising the steps of:

maintaining said rollers in an open position for a first time period prior to arrival of a sheet at said rollers;

closing said rollers with a relatively low closure force during a second time period prior to arrival of a sheet at said rollers wherein said second time period is subsequent to said first time period and is for a duration to stabilize the operating temperature distribution between said rollers; and closing said rollers with a relatively high closure force upon arrival of a sheet at said rollers for fusing said fusible material on said sheet as it passes between said rollers.

17. In a device that passes sheets having fusible material thereon between first and second rotatably driven rollers for fusing the material on said sheets with means mounting said rollers for movement between open and closed positions relative to the peripheral surfaces of said rollers and including means biasing said rollers into said open position, an improvement comprising:

means operable during a first time period prior to arrival of a sheet at said rollers for overcoming said biasing means and closing said rollers to stabilize the operational interaction between said rollers with a relatively low closure force between said rollers during at least a portion of said first time period; and means operable during a second time period beginning with the arrival of a sheet at said rollers for closing said rollers with a relatively high closure force to fuse the fusible material onto said sheets.

18. An improved device in accordance with claim 17 wherein said relatively low closure force closing means is operable for a time period corresponding to at least one rotation of said rollers.

19. An improved device in accordance with claims 17 or 18 which further includes means selectively operable for preventing said low closure force closing means from operating during intervals between sheets of a run after the first sheet of said run is fused.

20. An improved device in accordance with claim 19 wherein said high closure force closing means is operable for a predetermined time period; said closure force preventing means including means for interrupting operation of said high closure force closing means after operation thereof for a time period less than said predetermined time period.

* * * * *